US009027913B2

(12) United States Patent
Li

(10) Patent No.: US 9,027,913 B2
(45) Date of Patent: May 12, 2015

(54) SPRING CLAMP

(75) Inventor: Yueming Li, Hangzhou (CN)

(73) Assignees: Hangzhou Great Start Industrial Co., Ltd., Hangzhou (CN); Hangzhou Great Start Tools Co., Ltd., Hangzhou (CN)

( * ) Notice: Subject to any disclaimer, the term of this patent is extended or adjusted under 35 U.S.C. 154(b) by 25 days.

(21) Appl. No.: 13/582,063

(22) PCT Filed: Dec. 15, 2010

(86) PCT No.: PCT/CN2010/079841

§ 371 (c)(1),
(2), (4) Date: May 29, 2013

(87) PCT Pub. No.: WO2012/079234

PCT Pub. Date: Jun. 21, 2012

(65) Prior Publication Data

US 2013/0249154 A1 Sep. 26, 2013

(51) Int. Cl.

| | |
|---|---|
| ***B25B 3/00*** | (2006.01) |
| ***B25B 7/14*** | (2006.01) |
| ***B25B 7/06*** | (2006.01) |
| ***B25B 25/00*** | (2006.01) |
| ***B25B 5/16*** | (2006.01) |

(Continued)

(52) U.S. Cl.

CPC ... *B25B 7/14* (2013.01); *B25B 7/06* (2013.01); *B25B 25/00* (2013.01); *B25B 5/163* (2013.01); *B25B 5/04* (2013.01); *B25B 5/06* (2013.01); *B25B 7/16* (2013.01)

(58) Field of Classification Search

CPC ..... B25B 1/00; B25B 5/04; B25B 7/16; B25B 7/06; B25B 5/06; B25B 25/00; B25B 5/163

USPC ..... 269/6

See application file for complete search history.

(56) References Cited

U.S. PATENT DOCUMENTS 6,336,386 B1 * 1/2002 Lee ..... 81/328
6,564,703 B1 * 5/2003 Lin ..... 100/234

(Continued)

FOREIGN PATENT DOCUMENTS

CN 2654283 Y 11/2004
CN 2706278 Y 6/2005

(Continued)

OTHER PUBLICATIONS

International Search Report for PCT/CN2010/079841 dated Aug. 11, 2011.

*Primary Examiner* — Lee D Wilson
*Assistant Examiner* — Alvin Grant
(74) *Attorney, Agent, or Firm* — Heslin Rothenberg Farley & Mesiti P.C.

(57) ABSTRACT

A spring clamp includes a first body which comprises a gripping portion and a clamping portion, a second body which comprises a gripping portion and a clamping portion, a first pivot element which pivotally connects the first body and the second body, and a locking mechanism which comprises at least a pair of friction pair components. The first friction pair component is arranged on the first body, and includes a first friction pair element; and the second friction pair component is arranged on the second body, and includes a second friction pair element. The first and second friction pair elements rub against each other to effect the locking function. The rubbing of the friction pair elements occurs mainly in the plane perpendicular to the first pivot element axis.

21 Claims, 9 Drawing Sheets

(51) Int. Cl.

| | |
|---|---|
| ***B25B 5/04*** | (2006.01) |
| ***B25B 5/06*** | (2006.01) |
| ***B25B 7/16*** | (2006.01) |

(56) References Cited

U.S. PATENT DOCUMENTS

| | | | | |
|---|---|---|---|---|
| 6,698,734 | B1 * | 3/2004 | Wang | 269/6 |
| 6,708,587 | B1 | 3/2004 | Noniewicz | |
| 6,860,179 | B2 * | 3/2005 | Hopper et al. | 81/318 |
| 7,007,936 | B2 * | 3/2006 | Chang | 269/6 |
| 7,107,881 | B1 | 9/2006 | Liou | |
| 7,406,897 | B2 | 8/2008 | Hsu | |
| 7,669,505 | B2 * | 3/2010 | Campbell et al. | 81/409 |
| 7,735,814 | B2 * | 6/2010 | Ben-Gigi | 269/165 |
| 7,895,925 | B2 * | 3/2011 | Chang | 81/302 |
| 8,087,138 | B2 * | 1/2012 | Gupta | 29/270 |
| 8,137,379 | B2 * | 3/2012 | Labash | 606/204 |
| 8,286,954 | B2 * | 10/2012 | Zheng | 269/188 |

FOREIGN PATENT DOCUMENTS

| | | | |
|---|---|---|---|
| CN | 2801398 | Y | 8/2006 |
| CN | 2803626 | Y | 8/2006 |

* cited by examiner

SPRING CLAMP

FIELD OF THE INVENTION

The present invention relates to the field of mechanical tool and more particularly, to a spring clamp with stepless adjustment.

DESCRIPTION OF THE PRIOR ART

During the use of a spring clamp, the opening degree of the spring clamp nip is required to be adjusted according to the size of the clamped object. And the opening degree is preferred to be fixed in operation. In order to fix the adjusted opening degree, a large number of spring clamps with a locking mechanism has been known in the prior art.

U.S. Pat. No. 6,708,587B1 has disclosed a spring clamps, which has the manipulating component arranged on an outside of the clamp handle and can be thumb-operated, which simplifies the labor by hand. But the technical solution of providing rack pairs on the clamp handle actualizes a step adjustment.

The spring clamp disclosed in U.S. Pat. No. 6,860,179B2 and U.S. Pat. No. 7,406,897B2 has the manipulating component arranged on the inside of the clamp handle and can be operated with the index finger or ring finger, which enables good controllability. Its locking mechanism comprises an elongated holding strip and a rotatable locking bar. One end of the holding strip is pivotedly mounted on the handle while the other end extends towards the handle. In order to be adapted to the movement of the grip, the holding strip is an elongated arc strip plate-shaped member, and is arranged parallel to the pivot, i.e., the arc center position of the holding strip is at the pivot.

The locking bar can be pivoted, and an elongated opening is opened at the end adjacent to the pivot. The holding strip can slide through the opening. The other end of the lock bar is abutted by a spring. The spring pressure causes the opening to bias relative to the holding strip, and rubbing occurs at the edge of the arc holding strip and both ends or one end of the opening to actualize locking. When one press down the locking bar, overcoming the spring pressure, to let the holding strip edge detach from both edges of the opening, which actualizes the releasing.

The friction surfaces between the holding strip edges and both edges of the opening is substantially parallel to the pivot. As the holding strip is thin, the contact area between the holding strip edges and edges of both edges of the opening is usually a point contact or short line contact, which is easily overly worn. The reliability of its locking function will be gradually reduced in use, and the locking function will even become completely invalid when the wear reaches a certain extent, which make the entire spring clamp useless. Though according to the improved technology in the U.S. Pat. No. 6,860,179B2, i.e. the holding strip edge and both edges the opening adopting round corner structure, excessive wear still can not be completely avoided. Therefore, for such spring clamps, requirements for the material of the holding strip and the opening of the locking bar are high, which results in increased cost. The holding strip must be made into an arc shape, and the requirements for machining for its profile and size precision is high. And also high requirements for machining for the size precision in longitudinal direction of the opening, which directly results in an increased cost.

U.S. Pat. No. 7,107,881B1 disclosed a spring clamp, in one body of which a rod-shaped object is arranged in vertical direction, and locking or releasing the rod-shaped object via an L-shaped element to fix the degree of opening. As part of the L-shaped element projecting beyond the body, another hand is required to help the adjustment, which reduces the freedom of hands and the convenience in use. And the friction surface of the rod-shaped object and the L-shaped element is substantially parallel to the pivot, in which the aforementioned excessive wear and the decrease of the reliability of the locking function over a long-term use also reside, causing high requirements for the material and increased manufacturing cost.

Therefore, the person skilled in the art is committed to developing a spring clamp with stepless adjustment which can be conveniently adjusted and have good facilitation, reliability over long-term use and lower cost.

SUMMARY OF THE INVENTION

In view of the above-mentioned drawbacks of the prior art, the technical problem the present invention aims to solve is to provide a spring clamp with stepless adjustment which can be conveniently adjusted and have good facilitation, reliability over long-term use and lower cost.

To achieve the above object, the present invention provides a spring clamp, including a first body which includes a gripping portion and a clamping portion, a second body which includes a gripping portion and a clamping portion, a first pivot element which makes the first body and the second body couple together pivotedly, and a locking mechanism which comprises at least a pair of friction pair components; in the pair of friction pair components, the first friction pair component provided on the first body, including a first friction pair element; and the second friction pair component provided on the second body, including a second friction pair element; the friction interaction between the first friction pair element and the second friction pair element of the pair of friction pair components producing locking action; wherein the rubbing of the friction pair element occurs mainly in the plane perpendicular to the first pivot element axis.

In the spring clamp of the present invention, a pair of friction pair elements are arranged to contact and rub within a plane perpendicular to the first pivot element axis. Since the plane is wider, the contact portion can be set to the long line contact or surface contact, and there's a small amount of friction wear between the friction pair elements. Therefore, the material requirements for friction pair elements are lower and there's long-term reliable use and lower cost.

In a preferred embodiment of the present invention, the locking mechanism further comprises an unlocking mechanism to control the disengagement between the first and second friction pair element and release the lock between the first and second friction pair element. The unlocking mechanism further includes an operation handle, which can be handled by a finger pressing the operation handle, so that the unlocking mechanism plays the role of releasing the locking between the first and the second friction pair element.

In another preferred embodiment of the present invention, the first friction pair component is fixedly provided on the first body.

In another preferred embodiment of the present invention, the second friction pair component is fixedly provided on the second body.

In another preferred embodiment of the present invention, the first friction pair element is an elongated sheet, having at least one main surface located in a plane substantially perpendicular to the first pivot element axis, as the friction surface by which the first friction pair element contacts with the second friction pair element.

In the spring clamp of the present invention, the surface of the sheet-like first friction pair element functions as a friction surface in contact with the second friction pair element. There's less requirement of the contour shape of the sheet-like element which may be a circular arc shape, rectangular or other strip shape. There is less requirement of the size tolerance about the sheet-like element's width, reducing the processing costs.

In another preferred embodiment of the present invention, the second friction pair element is a needle, wedge block or eccentric cam constituting a friction pair element pair with the sheet-like first friction pair element. Or multiple needles, wedge blocks or eccentric cams constitute multiple pairs of friction pair elements with the sheet-like first friction pair element to play a locking action together.

In a preferred embodiment of the present invention, the second friction pair element is one needle at least.

Further, the second friction pair component comprises a clamp block the first friction pair element can penetrate, while the clamp block is provided with strip holes on its opposite sides and in the strip holes is disposed a needle which has one end at least exposed out of the strip holes; after the first friction pair element penetrates the clamp block, an angle is formed between the strip hole and the first friction pair element to control two states of contact or disengagement of the needle of the strip hole and the first friction pair element; a needle fixing ring is provided on the outside of the clamp block by an elastic member in order to limit the axis direction degree of freedom of the needle, while the needle can move in the strip hole in a direction of contacting the first friction pair element by the role of the elastic element; the working portion of the operation handle during rotating making the needle in the strip hole move in a direction of disengaging from the first friction pair element.

In a preferred embodiment of the present invention, the second friction pair element is one wedge block at least.

Further, the second friction pair component comprises a clamp block the first friction pair element can penetrate, while the clamp block is provided with a wedge block guide channel on its opposite sides and in the wedge block guide channel is disposed a wedge block which has at least one end exposed out of the wedge block guide channel; after the first friction pair element penetrates the clamp block, an angle is formed between the wedge block guide channel and the first friction pair element to control two states of contact or disengagement of the wedge block of the wedge block guide channel and the first friction pair element; a wedge block fixing ring is provided on the outside of the clamp block by an elastic member in order to limit the axis direction degree of freedom of the wedge block, while the wedge block can move in the wedge block guide channel in the direction of contacting the first friction pair element by the role of the elastic element; the working portion of the operation handle during rotating making the wedge block in the wedge block guide channel move in the direction of disengaging from the first friction pair element.

In another preferred embodiment of the present invention, the second friction pair element is one eccentric cam at least.

Further, the second friction pair component comprises a clamp block which the first friction pair element can penetrate, a cam provided on the clamp block pivoted by a torsion spring; after the first friction pair element penetrates the clamp block, the rotation of the cam providing two states of contact or disengagement of the cam and the first friction pair element; the operation handle is integrally molded with the cam, and the rotating of the operation handle making the cam disengage from the first friction pair element.

In another preferred embodiment of the present invention, the pivot joint of the first body and second body is located in the middle of the first body and the second body, so the gripping portions and the clamping portions of the first and second body are respectively at alternate sides of the pivot joint of the first body and second body.

Or, the pivot joint of the first body and second body is located in the ends of the first body and the second body, so the gripping portions and the clamping portions of the first and second body are at the same side of the pivot joint of the first body and second body.

In another preferred embodiment of the present invention, there's a half-open cavity in the first body and/or the second body, and the friction pair component is disposed in the cavity. The operation handle may be provided in the cavity, and at least part of the operation handle is located outside the cavity when clamping.

The operation handle is arranged on the inside of the body and mainly in the cavity of the body, which facilitates the user to operate the operation handle very conveniently and has greatly improved the facilitation of the spring clamp.

In another preferred embodiment of the present invention, the first friction pair element can be a shape of circular arc; further, the thickness of the first friction pair element is substantially uniform.

In another preferred embodiment of the present invention, the operation handle is integrally molded with the second friction pair element.

In another preferred embodiment of the present invention, the clamping portions of the first and/or second body are provided with movable clamp.

In another preferred embodiment of the present invention, part or all of the first and second body is coated with soft coating layer.

In another preferred embodiment of the present invention, there's a torsion spring for the first pivot element, which connects the first body and the second body together, to supply a tension between the first body and the second body.

The concept, structure and technical effects of the invention are further described with drawings in order to make the object, features and effects of the present invention understood.

DETAILED DESCRIPTION OF THE PREFERRED EMBODIMENTS

The Embodiment 1

Figure 1:
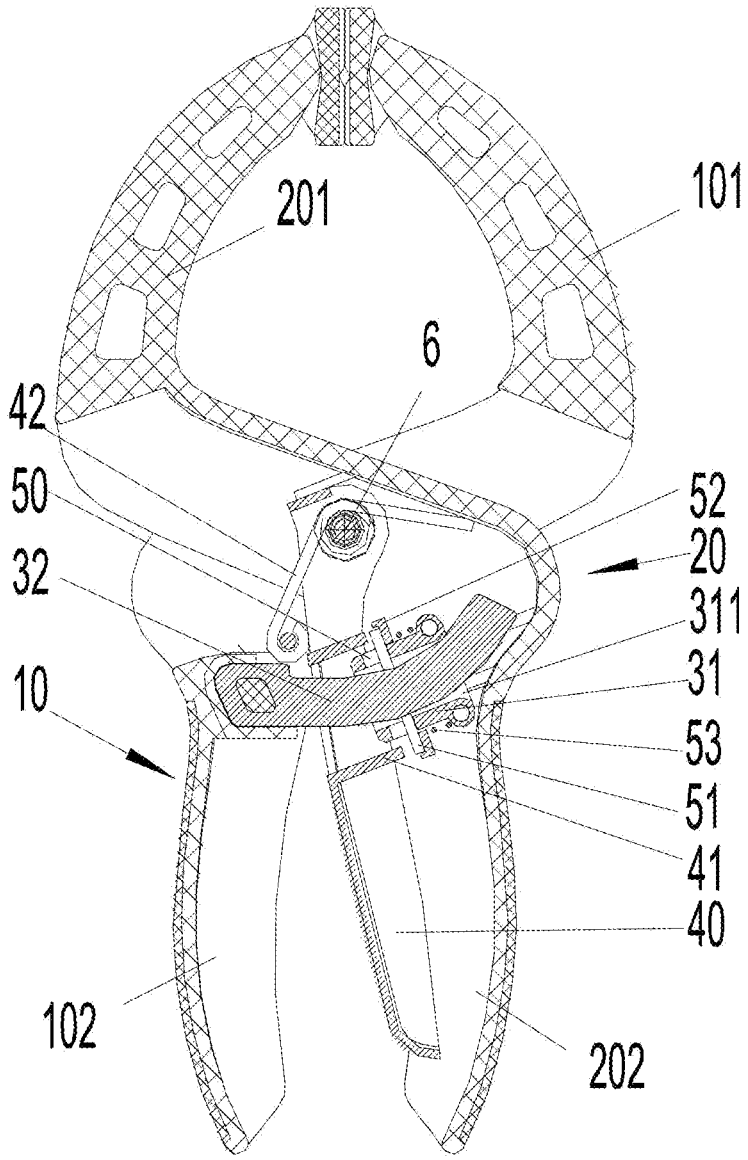
FIG. 1 is a schematic structural view of the first operating state (self-locking state) of the embodiment 1 of the present invention.
Figure 2:
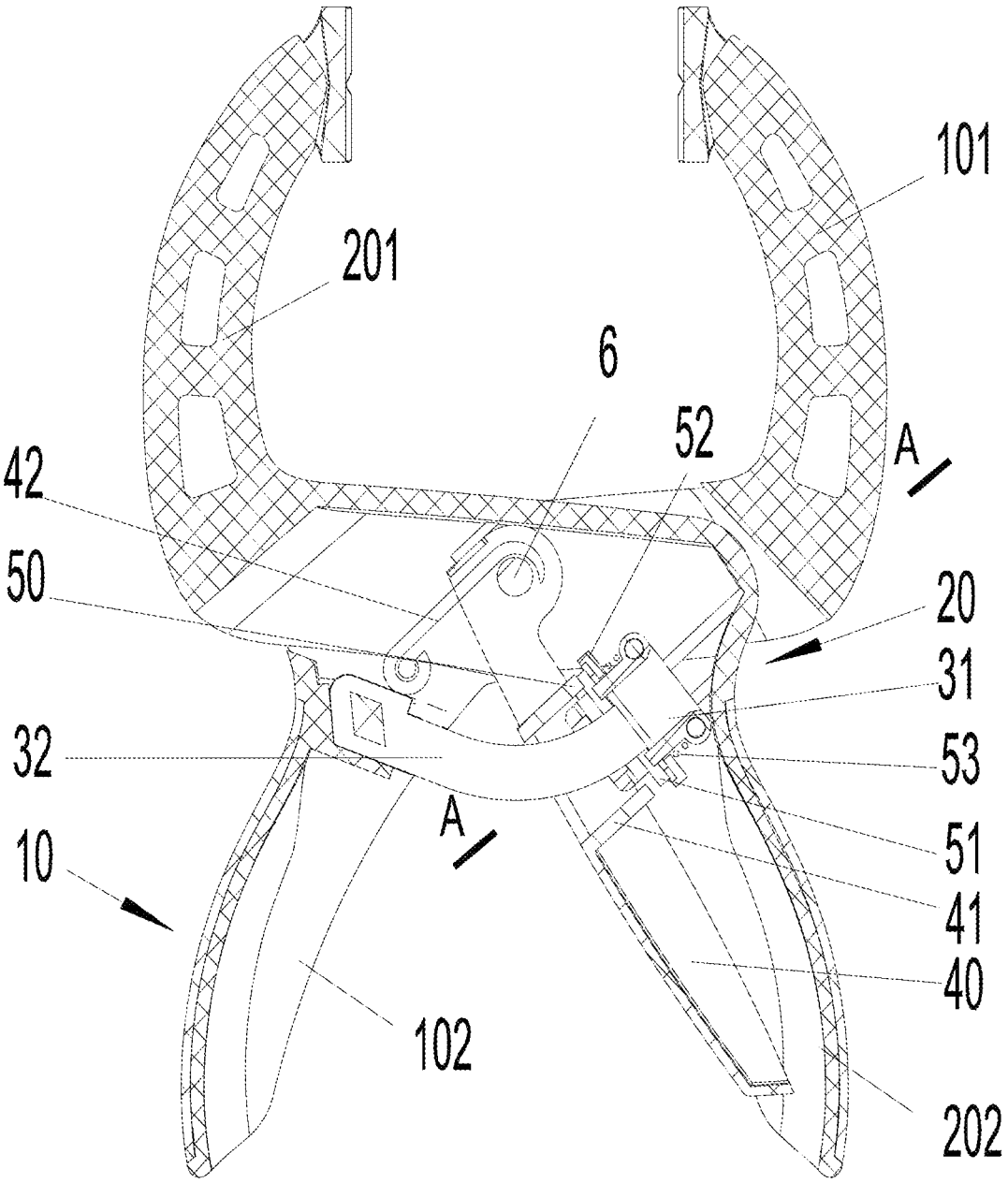
FIG. 2 is a schematic structural view of the second operating state (to be clamped state) of the embodiment shown in FIG. 1.
Figure 3:
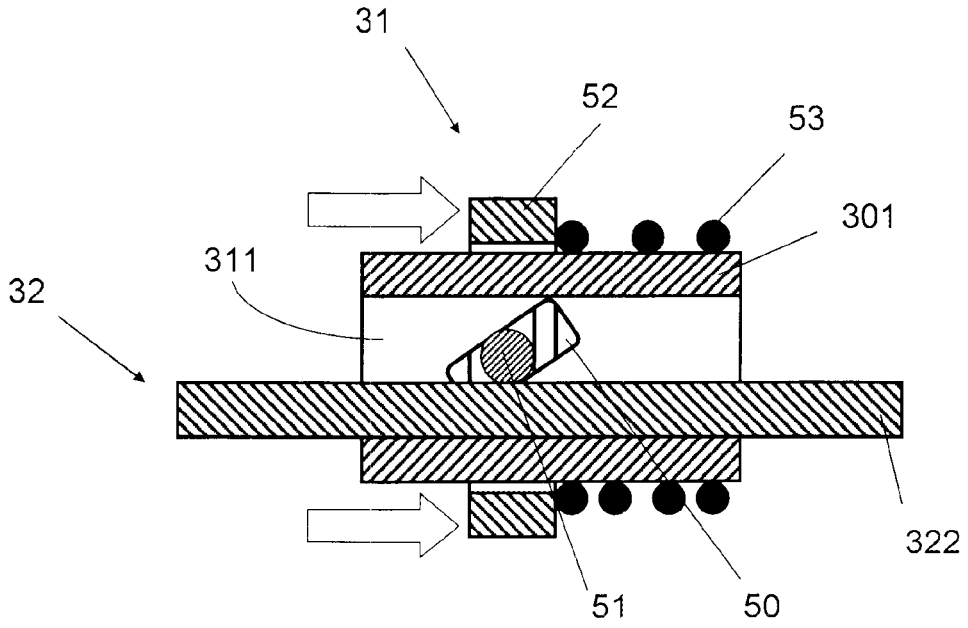
FIG. 3 is a schematic sectional structural view of the locking mechanism of the embodiment shown in FIG. 1 taken along line A-A.

As shown in FIG. 1 and FIG. 2, the spring clamp in an embodiment of the present invention comprises a first body 10, a second body 20, and a first pivot 6 which pivotally connect the first body 10 and the second body 20. The first body 10 and the second body 20 have gripping portions 102, 202 and clamping portions 101, 201 respectively. The clamping portions of two bodies 10, 20 can be arranged with movable clamping heads respectively to facilitate clamping.

The First pivot 6 is made of screws, bolt, rivet, etc., and is located in middle of the first body 10 and the second body 20, and the lower halves of the first body 10 and the second body 20 can each form into a half-open cavity, respectively. Moreover, the outside thereof may be coated with soft coating layer, such as leather, artificial leather, plastic or rubber, etc.

Further, the spring clamp in this embodiment includes a locking mechanism which comprises a pair of friction pair components, and the first friction pair component thereof is arranged on the first body 10, i.e. the holding strip 32 shown in the figure. The second friction pair component is arranged on the second body 20, comprising clamp block 301, needle 51, needle fixing ring 52 and elastic element 53.

The holding strip 32 is an elongated sheet with two oppositely facing main surfaces, having at least one main surface located in a plane substantially perpendicular to the first pivot 6 axis. The thickness of holding strip 32 is substantially uniform.

A passage 311 is provided in clamp block 301. One end 321 of holding strip 32 is fixedly arranged on first body 10. The other free end 322 and the clamp blocks 301 are opposite, which can penetrate passage 31. Free end 322 is a first friction pair element.

Figure 4:
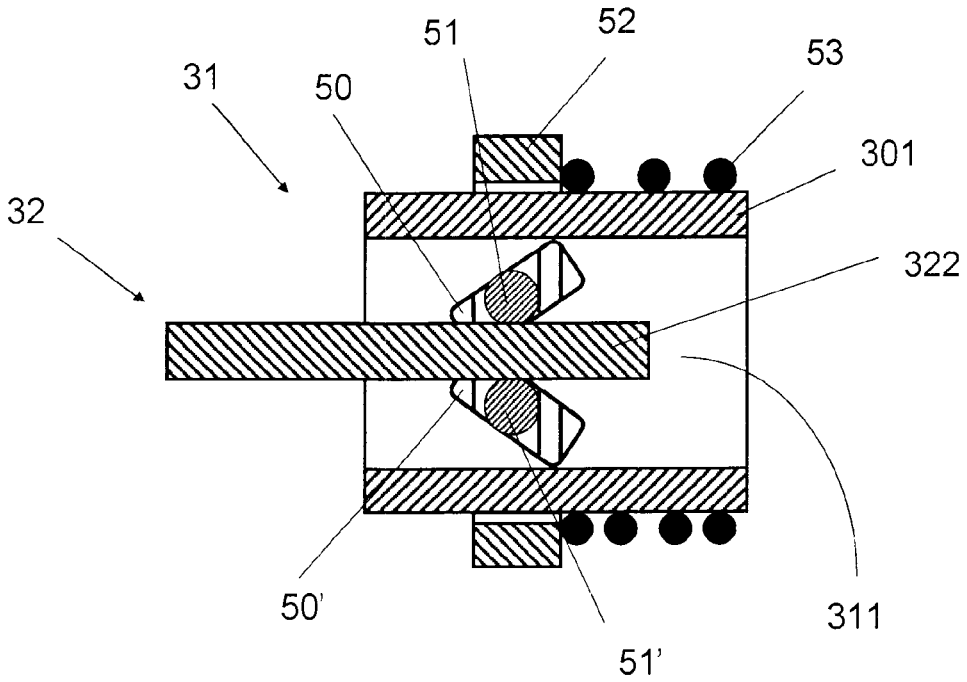
FIG. 4 is a schematic sectional structural view of the locking mechanism of the embodiment 2 taken along line A-A.

As shown in FIG. 4, clamp block 301 is fixedly provided on second body 20 (not shown). Both sides of clamp block 301 are provided with strip hole 50, and an angle is formed between strip hole 50 and free end of holding strip 322. Needle 51 having two ends exposed out of strip hole 50 is provided in strip hole 50. Needle 51 constitutes a second friction vise component. An elastic element 53 is provided on the outside of clamp block 301. Needle 51 can move in strip hole 50 toward the direction of approaching free end 322 of holding strip by the role of needle fixing ring 52. Meanwhile needle fixed ring 52 plays the role to limit the axial degree of freedom of needle 51.

Figure 12:
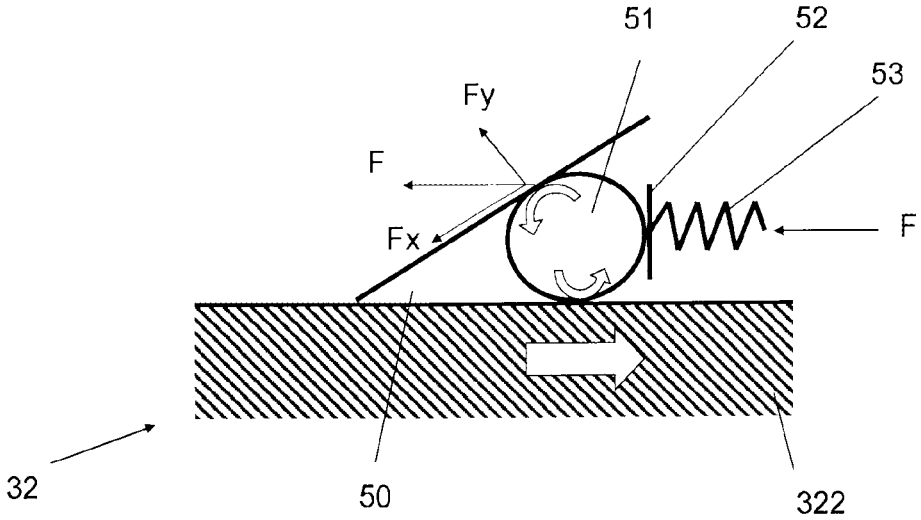
FIG. 12 is a analysis chart of needle stress under the second operating state of the embodiment shown in FIG. 2.

Since the presence of the angle described above, the spacing between needle 51 in strip hole 50 and free end 322 of holding strip is adjustable. When two gripping portions 102, 202 of spring clamp take opposite movement (depressing), free end 322 of holding strip slides freely in passage 311 and push needle 51 to overcome the pressure of elastic element 53; and needle 51 moves toward the direction of leaving free end 322 of holding strip. The gripping portion of spring clamp can take unidirectional movement freely in the depressing direction, so that the clamping portion of the spring clamp reaches the position of the sandwiched object. FIG. 12 shows the operation principle. The spring force F of elastic element 53 can be decomposed into tangential Fx and normal Fy in the contact surface of strip hole and needle 51. Fx causes the needle have the movement trend of counterclockwise rotation. Pressing the two gripping portions of the spring clamp is equivalent to pushing the free end 322 of the holding strip to the channel 311 (the push direction from left to right in the Figure). Needle 51 getting the friction of the free end 322 of the holding strip will have the movement trend of counterclockwise rotation too, that is, the free end 322 of the holding strip can uniaxially move freely from left to right, with the counterclockwise rotation of the needle 51.

The person skilled in the art should understand that the angle described above should be greater than the self-locking angle of the inclined surface, in order to avoid self-locking occurring. The degree of the self-locking angle is associated with the friction coefficient between the holding and the needle.

When the gripping portions 101,201 stop movement, the elastic member 53 applies spring force to the needle 51 via a needle fixing ring 52 to make the needle 51 press against the free end 322 of the holding strip, so the free end 322 of the holding strip can not exit and the locking is achieved.

The locking mechanism may also include an unlocking mechanism. The unlock mechanism includes an operation handle 40, which is provided on the second body 20 via torsion spring 42 and is rotatable for controlling the disengagement between the clamping block 301 and the holding strip 32. With the rotation of the operation handle 40, the working portion 41 of the operation lever 40 provides the force for pushing needle 51 to move in the strip hole 50 to the direction leaving the free end 322 of the holding strip, as the reaction force of the elastic element 53. In the arrow direction of FIG. 4, thrust is applied to the needle fixing ring 52 to overcome the spring force of the elastic element 53 (the operation handle not shown in the Figure). Needle 51 returns the relaxing state, and the holding strip 32 is released for unlocking whose free end 322 can freely slide within the passage 311.

Figure 13:
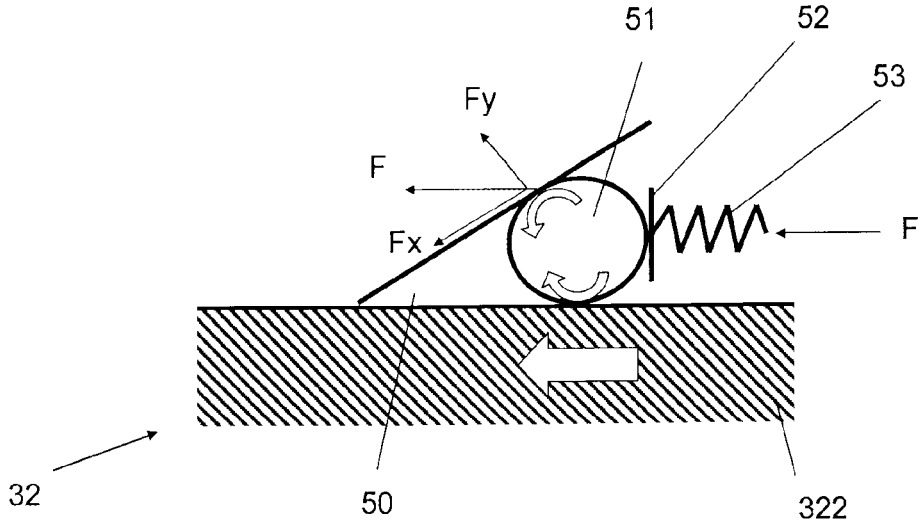
FIG. 13 is a analysis chart of needle stress under the first operating state of the embodiment shown in FIG. 1.

Below with reference to FIG. 1, FIG. 2 and FIG. 13, through the use of the spring clamp of the present invention, the working principle is described.

As shown in FIG. 1, the spring clamp is in the closed state, and no force is on the operation handle 40. The elastic element 53 pushes the needle fixing ring 52 and the needle 51 is pushed where the strip hole 50 is close to the holding strip 32. Since the frictional force between the needle 51 and the holding strip 32, the holding strip 32 is locked, and the spring clamp maintains a stable closed state.

When the user wants to pull the first body 10 and open the clamping portion, if not pressing the operation handle 40, due to the angle between the needle 51 and the holding strip 32 is an acute angle, the force of the holding strip 32 will drive the needle 51 to make the two squeezed more tightly. As shown in FIG. 13, the spring force F of the elastic element 53 can be decomposed into tangential Fx and normal Fy in the contact surface of the strip hole and the needle 51. Fx causes the needle have the movement trend of counterclockwise rotation. Wanting to pull the first body 10 and open the clamping portion is equivalent to pulling the free end 322 of the holding strip outward within the channel 311 (from right to left in the Figure). Needle 51 getting the friction of the free end 322 of the holding strip will have the movement trend of clockwise rotation. The two force interaction causes the needle 51 move only to the direction close to the free end 322 of the holding strip. So that the greater force applies on the spring clamp, the greater pressure is supplied to the free end 322 of the holding strip by the spring clamp, to clamp the free end 322 of the holding strip. So, needle 51 and the holding strip 32 are more firmly locked. Accordingly, the present invention achieves the self-locking of the first body 10 and the second body 20 by the simple structure above.

When the user wants to pull the first body 10 and open the clamping portion pressing the operation handle 40 at the same time, due to the role of the working portion 41 of the operation handle 40, the needle 51 can overcome the thrust of the elastic element 53 and move toward the direction of leaving the holding strip 32 in the strip hole 50. So the needle 51 and the holding strip 32 get out of touch, and the friction disappears so that the holding strip 32 is released. Accordingly, the first body 10 can be pulled and the clamping portion 101,201 can open by the role of torsion spring 42.

The realizing of the operation described above only needs the user to press the operation handle 40 with a finger of the same hand. Therefore the present invention has advantage of simple manipulation and one-hand operation.

When the opening of the clamping portion reaches a predetermined degree of opening, the pressing of the operation handle 40 stops. As disappearing of the force on the operation handle 40, the force of the elastic element 53 presses the needle 51 to move toward the holding strip 32 again, and frictional force is generated between the two, so that the holding strip 32 is locked.

Meanwhile as shown in FIG. 2, the degree of opening of the spring clamp is held in a stable state, providing the user with convenience.

When there's the need to adjust the opening degree of the clamping portion again, the realizing of the operation only needs the user press the operation handle 40 with a finger of the same hand.

In the present invention, as the structures of the strip hole 50 and the needle 51, it uses the operation handle 40 or the needle fixing ring 52, and by pushing the needle 51 to move in two opposite directions, achieves that the needle 5 is sandwiched tight with the holding strip 32 or detached from the holding strip 32, and the technical aim the degree of opening of the spring clamp can be steplessly adjusted to improve the performance of the application of the spring clamp.

In the present invention, the pair of friction pair elements composed of the needle 51 and the holding strip 32 is arranged to contact in the surface of the holding strip 32 and rub. Since the plane is wider, the contact portion can be set to the long line contact, and there's a small amount of friction wear between the needle 51 and the holding strip 32. Therefore, the material requirements for friction pair elements are lower and there's long-term reliable use and lower cost. Furthermore, in the present invention, the surface of the holding strip 32 works as the friction surface contacting the needle 51, which has less requirement of the contour shape of the holding strip 32 that may be a circular arc shape, rectangular or other strip shape. There're less requirements for the size tolerance about the width of the holding strip 32, reducing the processing cost.

Further, the lower half of the first body 10 and the second body 20 may provide a semi-open cavity. One end of the holding strip 32 is set in the cavity of the first body 10 and the clamp block is provided in the cavity of the second body 20. The operation handle 40 is in the cavity of the second body 20 and at least a portion of the operation handle 40 is outside the cavity under the state of its clamping so as to be pressed.

The Embodiment 2

The structure of the spring clamp in another embodiment of the present invention is similar to that of the embodiment 1, while the difference is the locking mechanism. As shown in FIG. 4, there're two sets of strip hole 50 and 50' provided in the clamp block 301 of the locking mechanism. There're two needles 51 and 51' with two ends exposed out of the strip holes. Needle 51 and the free end 322 of the holding strip make up a set of pairs of friction pair elements while needle 51' and the free end 322 of the holding strip make up another set of pairs of friction pair elements. The two sets of pairs of friction pair elements interact with each other to achieve the function of stepless locking of the spring clamp in the present embodiment.

The working principle of the present embodiment is the same as the embodiment 1, so it is not restated.

The Embodiment 3

Figure 5:
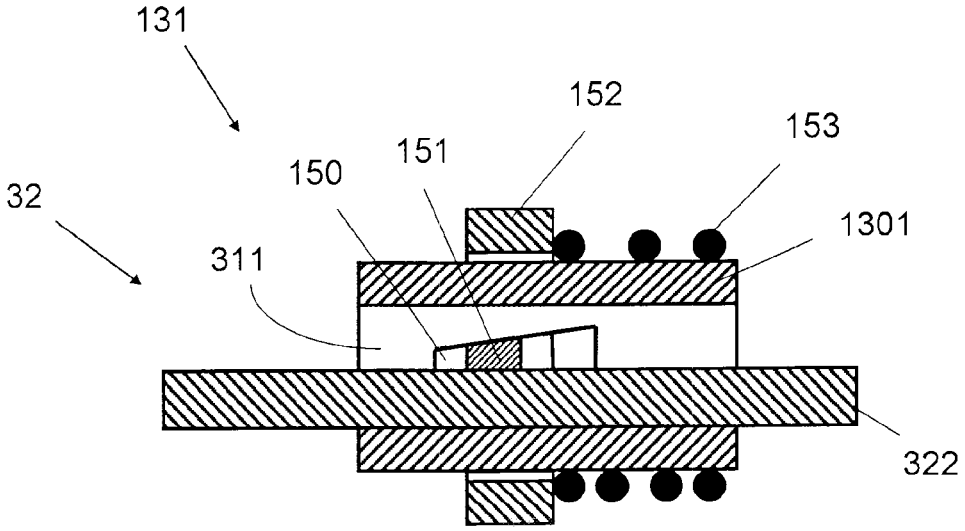
FIG. 5 is a schematic sectional structural view of the locking mechanism of the embodiment 3 taken along line A-A.

The structure of the spring clamp in another embodiment of the present invention is similar to that of the embodiment 1, the difference is that the second friction pair component of the locking mechanism is replaced by a new second friction pair component 131, which comprises clamp block 1301, wedge block 151, wedge block fixing ring 152 and elastic element 153 as shown in FIG. 5. The clamp block 1301 is provided with wedge block guide channel 150 on both sides, and the wedge block 151 in the wedge block guide channel 150 is provided, which has two ends exposed out of the wedge block guide channel 150. The wedge block 151 constitutes the second friction pair element. On the outside of the clamp block 1301 is provided an elastic element 153, and the wedge block 151 is pushed by a wedge block fixing ring 152 to move toward the direction close to the free end 322 of the holding strip along the wedge block guide channel 150. The wedge block fixing ring 152 also serves to prevent the wedge block 151 from dropping out of the wedge block guide channel 150.

Since the contact is set to surface contact, and there's a small amount of friction wear between the friction pair elements. Therefore, the material requirements for friction pair elements are lower and there's long-term reliable use and lower cost.

The working principle of the present embodiment is the same as the embodiment 1, so it is not restated.

The Embodiment 4

Figure 6:
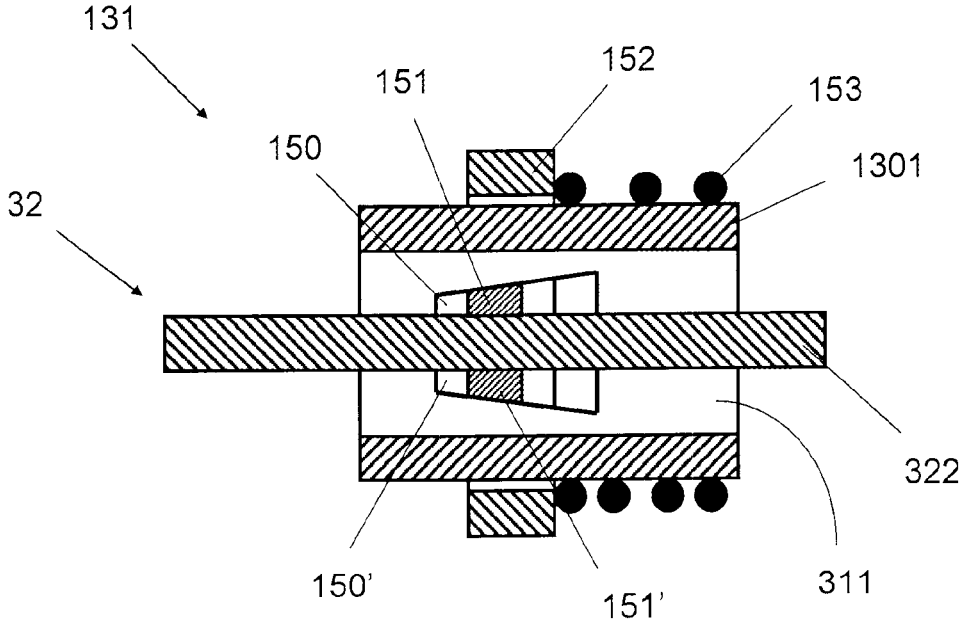
FIG. 6 is a schematic sectional structural view of the locking mechanism of the embodiment 4 taken along line A-A.

The structure of the spring clamp in another embodiment of the present invention is similar to that of the embodiment 3, while the difference as shown in FIG. 6 is that the clamp block 1301 of the locking mechanism is provided with two sets of wedge block guide channel 150 and 150'. There're two wedge blocks 151 and 151' with two ends exposed out of the wedge block guide channels.

The wedge block 151 and the free end 322 of the holding strip make up a set of pairs of friction pair elements while wedge block 151' and the free end 322 of the holding strip make up another set of pairs of friction pair elements. The two sets of pairs of friction pair elements interact with each other to achieve the function of stepless locking of the spring clamp in the present embodiment.

The working principle of the present embodiment is the same as the embodiment 3, so it is not restated.

The Embodiment 5

The structure of the spring clamp in another embodiment of the present invention similar to that of the embodiment 1, comprises a first body 10, a second body 20, a first pivot 6 which makes the first body 10 and the second body 20 couple pivoted, and a locking mechanism. The first body 10 and the second body 20 have the gripping portion 102, 202 and the gripping portion 101,201 respectively. The difference is that the unlocking mechanism of the locking mechanism and the second friction pair component are mounted together, in particular, the operation handle is integrally molded with the second friction pair element.

Figure 7:
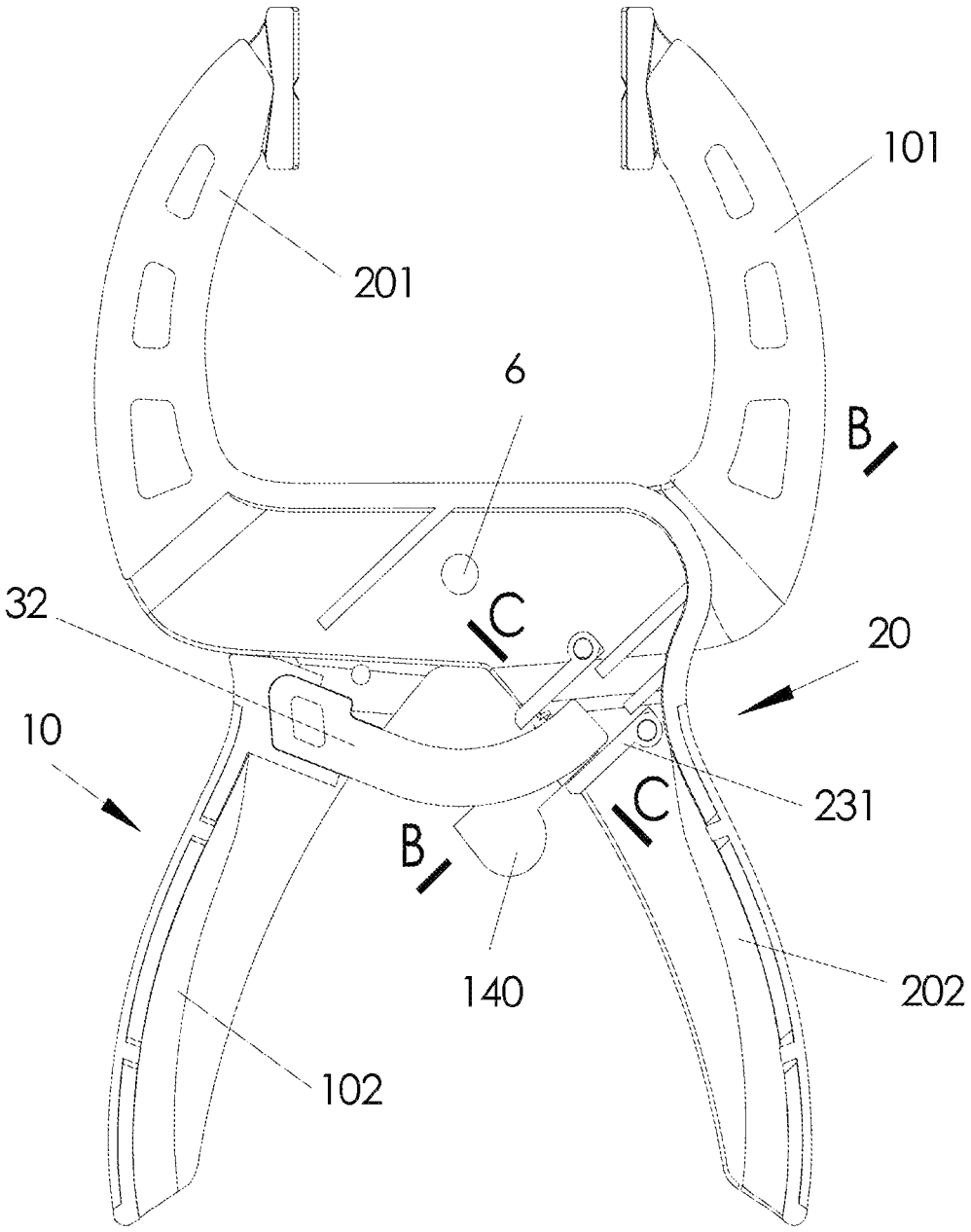
FIG. 7 is a schematic structural view of the embodiment 5 of the present invention.

Specifically, as shown in FIG. 7, the locking mechanism comprises a pair of friction pair components, and the first friction pair component is provided on the first body 10, i.e. the holding strip 32 shown in the view. The second friction pair component is provided on the second body 20, comprising clamp block 2301, cam 141, torsion spring 142 and shaft 143.

Figure 8:
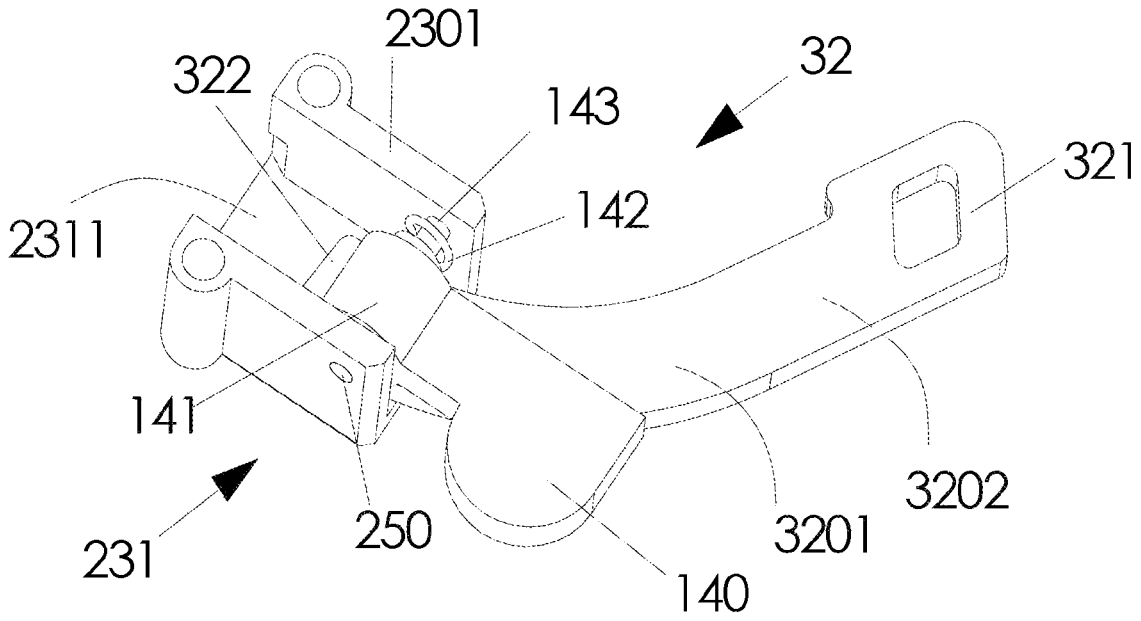
FIG. 8 is a schematic structural view of the locking mechanism and the unlocking mechanism of the embodiment shown in FIG. 7.

As shown in FIG. 8, clamp block 2301 having a groove structure of half-opening "[" character is provided on the body 20. The clamp block 2301 has holes 250 on both sides. Spindle 143 is set up. Cam 141 is provided on the shaft 143 by torsion spring 142 on the shaft 143. The cam 141 constitutes the second friction pair element. The working surface of the cam 141 is part of a cylindrical surface at least, and the axis of the cylindrical surface deviates from the rotary shaft 143 of the cam 141. In order to clearly illustrate the present invention, the generatrix on the working surface of cam 141 closest to the groove recessed bottom surface of the clamp block 2301 is defined as the cam outer periphery 1411.

A channel 2311 is formed by the groove of clamp block 2301 and the cam 141. The four sides of the channel 2311 are the opposite sides 2301 and 2303 of the groove, and the opposite sides which are the groove bottom surface 2302 and the cam outer periphery 1411.

The holding strip 32 is an elongated sheet having two opposite main surfaces 3201 and 3202, wherein at least one main surface is located in a plane substantially vertical to the first pivot 6 axis. The thickness of the holding strip 32 is uniform. One end 321 of the holding strip 32 is fixed on the first body 10, while the other free end 322 and the clamp block 2301 are opposite, which is able to penetrate the channel 2311. And the groove bottom surface 2302 of the channel 2311 and one main surface of the holding strip 32 are substantially parallel when free end 322 penetrating the channel 2311. The free end 322 is the first friction pair element.

Figure 9:
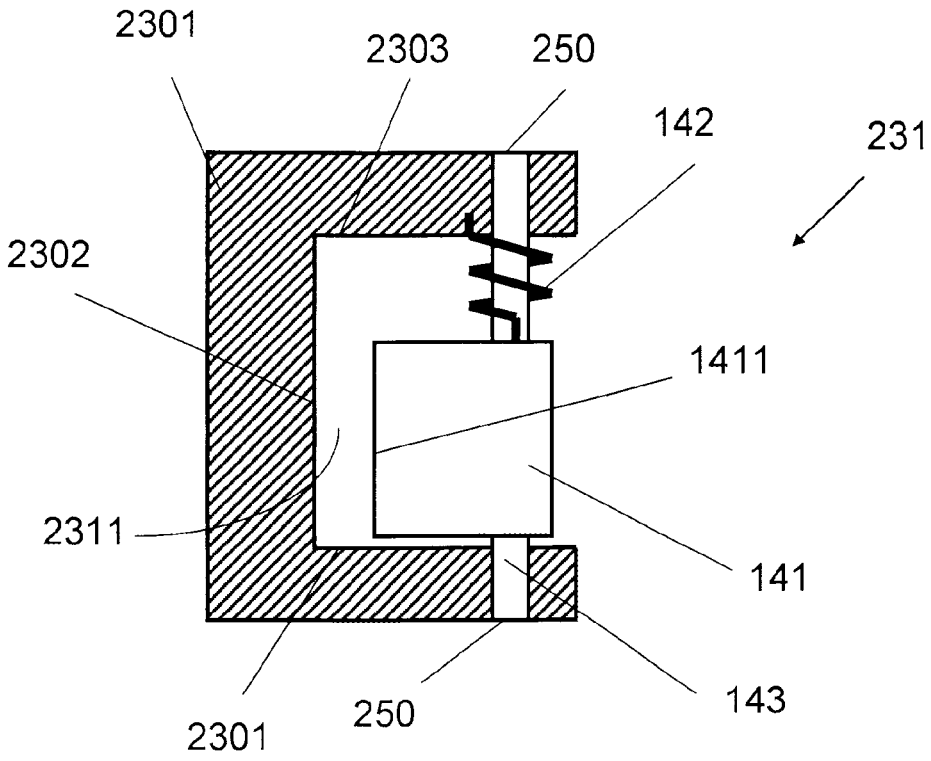
FIG. 9 is a schematic sectional structural view of the second friction pair element of the embodiment shown in FIG. 7 taken along line C-C.

As shown in FIG. 9, the height of the channel 2311 is defined by the sides 2301 and 2303. Defining of the height is related to the outer contour where the free end 322 of the holding strip 32 is perpendicular to the main surface. When the outer contour is an arc which takes the first pivot 6 as the center of the arc, the height is minimum. In fact, the outer contour shape of the free end 322 may be other shapes, for example rectangle. The height can appropriately increase correspondingly, to be adapted to the outer contour shape of the free end 322.

The width of the channel 2311 is defined by the groove bottom surface 2302 and the cam outer periphery 1411. In FIG. 9, when the cam 141 rotates on the shaft 143, the cam outer periphery 1411 moves around with the rotation of the cam 141, so that the width of the channel 2311 changes accordingly, and the cam 141 and the holding strip 32 have two states of contact or detachment to clamp or loosen the free end 322 of the holding strip 32 penetrating the channel 2311. So it should be understood that the designing of the cam 141 can make the minimum width of the channel 2311 slightly less than the thickness of the free end 322 of the holding strip 32.

Figure 11:
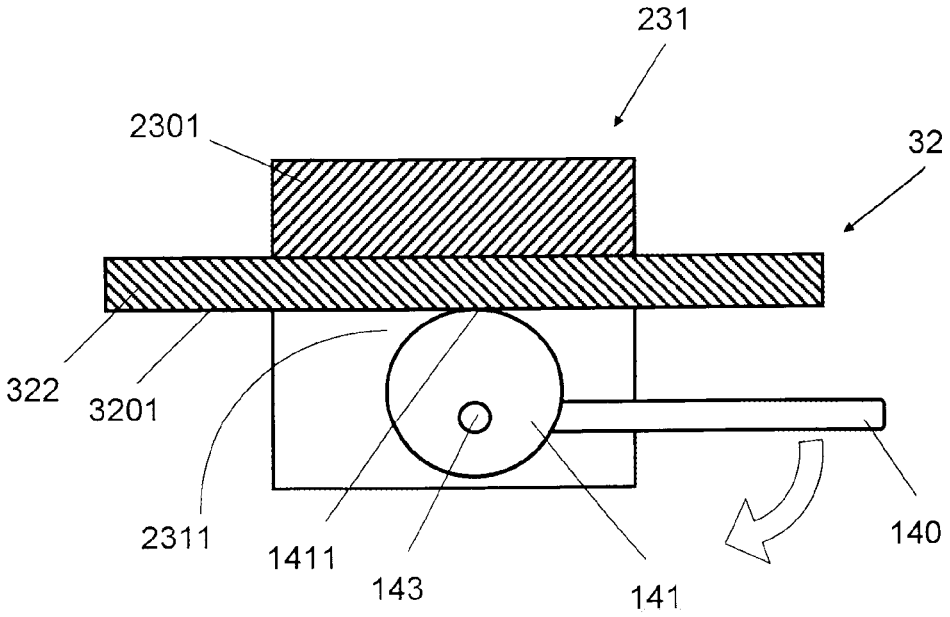
FIG. 11 is a schematic sectional structural view of the locking mechanism and the unlocking mechanism of the embodiment shown in FIG. 7 taken along line B-B.

As shown in FIG. 7, the cam 141 is coupled to the operation handle 140, or, the cam 141 and the operation handle 140 are integrally molded. Referring to FIG. 11, the mutual relationship of the operation handle 140 and the cam 141 should be designed to: when the operation handle 140 is substantially parallel to the holding strip 32, the cam 141 is in position contacting with the holding strip; when the operation handle 140 rotated by an angle of less than 90 degree, the cam 141 and the holding strip get out of touch.

Figure 10:
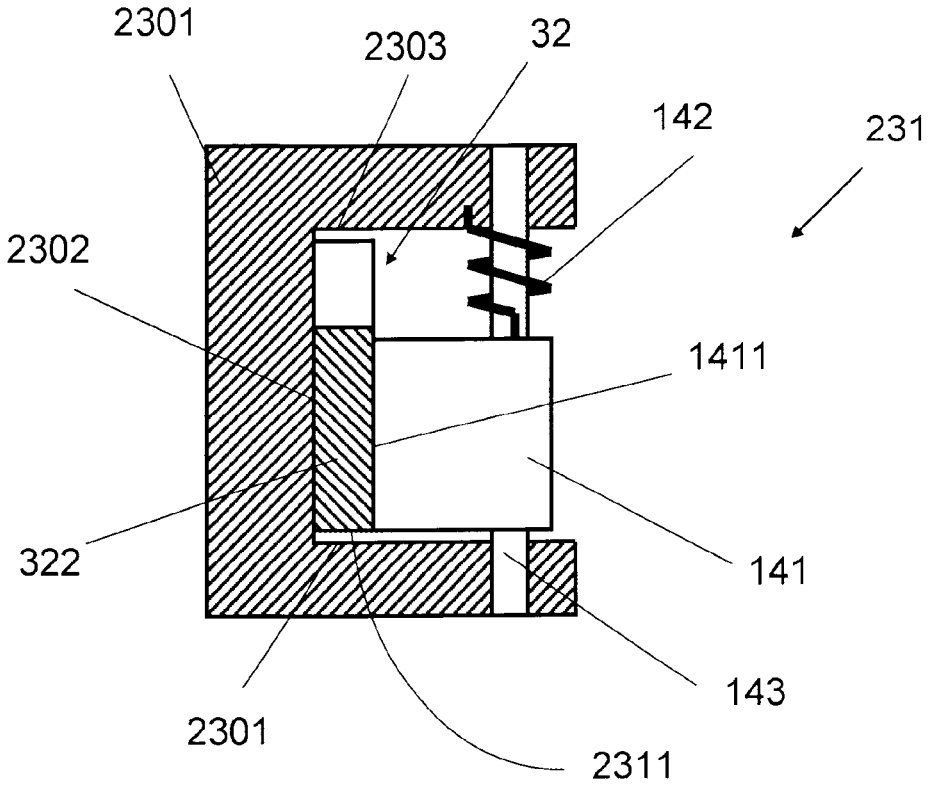
FIG. 10 is a schematic sectional structural view for of the operating state of the locking mechanism of the embodiment shown in FIG. 7 taken along line C-C.

With reference to FIG. 10, 11, the working principle is described by the use of the spring clamp of the present invention.

As shown in FIG. 11, in the close state of the spring clamp, no force is applied on the operation handle 140. The torsion spring 142 (seen FIG. 10) pushes the cam 141, and the width of the channel 2311 reaches the minimum, due to the frictional force between the main surface 3201 of the free end 322 of the holding strip 32 and the cam outer periphery 1411 (seen FIG. 10). The holding strip 32 is locked, and the spring clamp maintains a stable close state.

When the user wants to pull the first body 10 and open the clamping portion, if the user doesn't press the operation handle 140, due to the friction angle between the cam 141 and the main surface 3201 is an acute angle, the force pulling the holding strip 32 will drive the cam 141, so that the two are squeezed more tightly. Hence, the cam 141 and the holding strip 32 are locked more securely. Accordingly, in the present invention the self-locking of the first body 10 and the second main body 20 achieves via the simple structure above.

When the user wants to pull the first body 10 and open the clamping portion, pressing the operation handle 140 at the same time as the direction of the arrows in FIG. 11, the cam 141 of the operation handle 40 can overcome the thrust of the torsion spring 142 and the cam outer periphery 1411 moves toward the direction of leaving the holding strip 32. So the cam 141 and the holding strip 32 get out of touch, and the friction disappears so that the holding strip 32 is released. Accordingly, the first body 10 can be pulled and the clamping portion can open.

The realizing of the operation described above only needs the user to press the operation handle 140 with a finger of the same hand. Therefore the present invention has advantage of simple manipulation and one-hand operation.

When the opening of the clamping portion reaches a predetermined degree of opening, the pressing of the operation handle 140 stops. As disappearing of the force on the operation handle 140, the force of the torsion spring 142 presses the cam 141 to move toward the holding strip 32 again, and frictional force is generated between the two, so that the holding strip 32 is locked. Meanwhile the degree of opening of the spring clamp is held in a stable state, providing the user with convenience.

When there's the need to adjust the opening degree of the clamping portion again, the realizing of the operation only needs the user press the operation handle 140 with a finger of the same hand.

The present embodiment, as the structures of the cam 141 connecting with the operation handle 140, uses the operation handle 140 or the torsion spring 142, and by pushing the cam 141 rotating, achieves that the cam 141 is sandwiched tight with the holding strip 32 or detached from the holding strip 32, and the technical aim the degree of opening of the spring clamp can be steplessly adjusted to improve the performance of the application of the spring clamp.

In the present embodiment, the pair of friction pair elements composed of the cam 141 and the holding strip 32 is arranged to contact in the surface of the holding strip 32 and rub. Since the plane is wider, the contact portion can be set to the long line contact, and there's a small amount of friction wear between the cam 141 and the holding strip 32. Therefore, the material requirements for friction pair elements are lower and there's long-term reliable use and lower cost. Furthermore, in the present invention, the surface of the holding strip 32 works as the friction surface contacting the cam 141, which has less requirement of the contour shape of the holding strip 32 that may be a circular arc shape, rectangular or other strip shape. There're less requirements for the size tolerance about the width of the holding strip 32, reducing the processing cost.

In other embodiments of the present invention, the pivot joint of the first body and the second body can also be located at the end portion of the first body and the second body.

The techniques described herein are exemplary, and should not be construed as implying any particular limitation on the present disclosure. It should be understood that various alternatives, combinations and modifications could be devised by those skilled in the art. The present disclosure is intended to embrace all alternatives, modifications and variances that fall within the scope of the appended claims.

The invention claimed is:

1. A spring clamp, comprising:

a first body which includes a gripping portion and a clamping portion;

a second body which includes a gripping portion and a clamping portion;

a first pivot element which pivotally connects the first body and the second body at a pivot joint for pivotal movement about a first pivot element axis; and a locking mechanism, which comprises at least a pair of friction pair components; wherein:

a first friction pair component of the pair is provided on the first body and includes a first friction pair element; and a second friction pair component of the pair is provided on the second body and includes a second friction pair element;

the friction pair components arranged in pairs has the first friction pair element and the second friction pair element therein, which form a pair of friction pair elements and effect a locking function through rubbing against each other, wherein the rubbing of the friction pair elements mainly occurs in a plane perpendicular to the first pivot element axis; and wherein the first friction pair element comprises an elongated sheet, having at least one main surface located in a plane substantially perpendicular to the first pivot element axis as a friction surface contacted with the second friction pair element.

2. The spring clamp according to claim 1, wherein the locking mechanism further comprises an unlocking mechanism to release the locking function between the first and second friction pair element.

3. The spring clamp according to claim 2, wherein the unlocking mechanism further comprises an operation handle, which can be handled by a finger pressing the operation handle, so that the unlocking mechanism releases the locking function between the first and the second friction pair element.

4. The spring clamp according to claim 1, wherein the first friction pair component is fixedly provided on the first body.

5. The spring clamp according to claim 3, wherein the second friction pair component is fixedly provided on the second body.

6. The spring clamp according to claim 3, wherein the second friction pair element comprises at least one needle.

7. The spring clamp according to claim 6, wherein the second friction pair component comprises:

a clamp block which the first friction pair element can penetrate, the clamp block is provided with strip holes on its opposite sides and in the strip holes a needle is provided which has one end at least exposed out of the strip holes; after the first friction pair element penetrates the clamp block, an angle is formed between the strip hole and the first friction pair element to control two states of contact or disengagement of the needle of the strip hole and the first friction pair element; and a needle fixing ring provided on an outside of the clamp block by an elastic member in order to limit axis direction degree of freedom of the needle, the needle can move in the strip hole in a direction of contacting the first friction pair element by a role of the elastic element;

a working portion of the operation handle during rotating makes the needle in the strip hole move in a direction of disengaging from the first friction pair element.

8. The spring clamp according to claim 3, wherein the second friction pair element comprises at least one wedge block.

9. The spring clamp according to claim 8, wherein the second friction pair component comprises a clamp block which the first friction pair element can penetrate, the clamp block is provided with a wedge block guide channel on its opposite sides and in the wedge block guide channel a wedge block is provided which has at least one end exposed out of the wedge block guide channel; after the first friction pair element penetrates the clamp block, an angle is formed between the wedge block guide channel and the first friction pair element to control two states of contact or disengagement of the wedge block of the wedge block guide channel and the first friction pair element; and a wedge block fixing ring provided on an outside of the clamp block by an elastic member in order to limit axis direction degree of freedom of the wedge block, the wedge block can move in the wedge block guide channel in a direction of contacting the first friction pair element by a role of the elastic element;

a working portion of the operation handle during rotating makes the wedge block in the wedge block guide channel to move in a direction of disengaging from the first friction pair element.

10. The spring clamp according to claim 1, wherein the second friction pair element comprises at least one eccentric cam.

11. The spring clamp according to claim 10, wherein the second friction pair component comprises:

a clamp block which the first friction pair element can penetrate; and a cam pivotedly provided on the clamp block by a torsion spring; after the first friction pair element penetrates the clamp block, rotation of the cam providing two states of contact or disengagement of the cam and the first friction pair element;

an operation handle integrally molded with the cam, and the rotating of the operation handle making the cam disengage from the first friction pair element.

12. The spring clamp according to claim 1, wherein the gripping portions and the clamping portions of the first and second body are located on alternate sides of the pivot joint of the first body and second body, respectively.

13. The spring clamp according to claim 1, wherein the gripping portions and the clamping portions of the first and second body are located on a same side of the pivot joint of the first body and second body.

14. The spring clamp according to claim 3, wherein a half-open cavity is provided in the first body or in the second body.

15. The spring clamp according to claim 14, wherein at least part of the first friction pair component or the second friction pair component is disposed in the half-open cavity.

16. The spring clamp according to claim 15, wherein the operation handle may be provided in the half-open cavity and at least part of the operation handle is located outside the half-open cavity when clamping.

17. The spring clamp according to claim 1, wherein the first friction pair element has a shape a of circular arc.

18. The spring clamp according to claim 1, wherein thickness of the first friction pair element is substantially uniform.

19. The spring clamp according to claim 1, wherein the clamping portion of the first body or the second body is provided with a movable clamp.

20. The spring clamp according to claim 1, wherein part or all of the first body and the second body is coated with a soft coating layer.

21. The spring clamp according to claim 1, wherein a torsion spring is provided for the first pivot element, which connects the first body and the second body together, supplying a tension between the first body and the second body.

* * * * *

UNITED STATES PATENT AND TRADEMARK OFFICE

CERTIFICATE OF CORRECTION

PATENT NO. : 9,027,913 B2
APPLICATION NO. : 13/582063
DATED : May 12, 2015
INVENTOR(S) : Yueming Li It is certified that error appears in the above-identified patent and that said Letters Patent is hereby corrected as shown below:

Title Page

In the Assignee (73): Delete "Hangzhou Great Start Industrial Co., LTD. (CN) and Hangzhou Great Start Tools Co., LTD. (CN)" and insert -- Hangzhou Great Star Industrial Co., LTD. (CN) and Hangzhou Great Star Tools Co., LTD. (CN) --

Signed and Sealed this
Tenth Day of November, 2015

Michelle K. Lee

Michelle K. Lee
*Director of the United States Patent and Trademark Office*